US011376808B2

(12) United States Patent
Mbarek

(10) Patent No.: US 11,376,808 B2
(45) Date of Patent: Jul. 5, 2022

(54) DEVICE FOR PRODUCING PACKAGING COMPRISING AN INDEPENDENT MANDREL WHEEL DRIVE

(71) Applicant: SIG Technology AG, Neuhausen am Rheinfall (CH)

(72) Inventor: Taoufik Mbarek, Wuerselen (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 0 days.

(21) Appl. No.: 16/621,522

(22) PCT Filed: May 30, 2018

(86) PCT No.: PCT/EP2018/064143

§ 371 (c)(1),
(2) Date: Dec. 11, 2019

(87) PCT Pub. No.: WO2019/001883

PCT Pub. Date: Jan. 3, 2019

(65) Prior Publication Data

US 2020/0101687 A1 Apr. 2, 2020

(30) Foreign Application Priority Data

Jun. 30, 2017 (DE) ..... 102017114614.8

(51) Int. Cl.
*B31B 50/02* (2017.01)
*B31B 50/32* (2017.01)
(Continued)

(52) U.S. Cl.
CPC ..... *B31B 50/024* (2017.08); *B31B 50/322* (2017.08); *B31B 2110/35* (2017.08); *B31B 2120/302* (2017.08)

(58) Field of Classification Search
CPC ..... B31B 50/024; B31B 50/322; B31B 50/32; B31B 50/28; B31B 50/64;
(Continued)

(56) References Cited

U.S. PATENT DOCUMENTS 3,566,762 A * 3/1971 Vadas ..... B65B 3/025 493/134
3,619,979 A * 11/1971 Martensson ..... B65B 3/025 53/565
(Continued)

FOREIGN PATENT DOCUMENTS

CN 103987516 A 8/2014
CN 104325710 A 2/2015
(Continued)

*Primary Examiner* — Thomas M Wittenschlaeger
(74) *Attorney, Agent, or Firm* — The Webb Law Firm

(57) ABSTRACT

Shown and described is a device for producing packaging, in particular for processing package sleeves, comprising: a mandrel wheel with a mandrel wheel shaft with a central axis, a plurality of mandrels fastened to the mandrel wheel shaft, wherein the mandrels form at least one mandrel group, whose mandrels are arranged in a plane perpendicular to the central axis of the mandrel wheel shaft, at least one first processing station which is arranged on the mandrel wheel and comprises a drive, and a mandrel wheel drive to drive the mandrel wheel shaft. In order to facilitate a particular flexible mode of driving the device, it is proposed that the mandrel wheel drive is mechanically uncouple from the drive the at least one processing station.

13 Claims, 2 Drawing Sheets

(51) Int. Cl.
*B31B 120/30* (2017.01)
*B31B 110/35* (2017.01)

(58) Field of Classification Search
CPC ..... B31B 2100/0022; B31B 2110/35; B31B 2120/302; B31B 2120/30
See application file for complete search history.

(56) References Cited

U.S. PATENT DOCUMENTS 4,588,391 A * 5/1986 Evans ..... B65B 3/025 198/429
4,838,847 A * 6/1989 Kume ..... B65D 5/061 493/133
4,924,657 A * 5/1990 Berti ..... B65B 57/00 53/450
5,120,292 A * 6/1992 Ueda ..... B31B 50/00 493/124
5,488,812 A * 2/1996 Stark ..... B65B 59/04 53/266.1
5,492,592 A * 2/1996 Bergholtz ..... B65B 61/186 156/308.2
5,704,541 A * 1/1998 Mogard ..... B65D 5/746 229/125.15
5,706,627 A * 1/1998 Kirka ..... B29C 65/08 53/52
5,966,897 A * 10/1999 Kirka ..... B29C 65/08 53/55
6,374,580 B1 * 4/2002 Kujubu ..... B65B 31/022 53/376.2
6,484,475 B1 * 11/2002 Neagle ..... B65B 59/04 53/167
9,776,753 B2 * 10/2017 Baltes ..... B65B 43/56
10,011,379 B2 * 7/2018 Baltes ..... B65B 43/24
10,196,163 B2 * 2/2019 Baltes ..... B65B 43/285
10,464,264 B2 * 11/2019 Heil ..... B29C 66/851
10,703,516 B2 * 7/2020 Mainz ..... B65B 65/003
2008/0078652 A1 * 4/2008 Arnett ..... B65G 47/841 198/341.01
2014/0206514 A1 * 7/2014 Lootvoet ..... B31B 50/02 493/52
2015/0068163 A1 3/2015 Baltes et al.
2016/0257089 A1 * 9/2016 Deering ..... B31B 50/062
2018/0071996 A1 3/2018 Heil

FOREIGN PATENT DOCUMENTS

DE 69738295 T2 3/2008
DE 102012102812 A1 10/2013
DE 102012112792 A1 6/2014
DE 102015101751 A1 8/2016
DE 102015104102 A1 9/2016
JP S485712 2/1973
JP 200130379 A 2/2001
JP 2010195025 A 9/2010
WO 2013053646 A1 4/2013

* cited by examiner

DEVICE FOR PRODUCING PACKAGING COMPRISING AN INDEPENDENT MANDREL WHEEL DRIVE

CROSS-REFERENCE TO RELATED APPLICATIONS

This application is the United States national phase of International Application No. PCT/EP2018/064143 filed May 30, 2018, and claims priority to German Patent Application No. 10 2017 114 614.8 filed Jun. 30, 2017, the disclosures of which are hereby incorporated by reference in their entirety.

BACKGROUND OF THE INVENTION

Field of the Invention

The invention relates to a device for producing packaging, in particular for processing package sleeves, comprising: a mandrel wheel with a mandrel wheel shaft with a central axis, a plurality of mandrels fastened to the mandrel wheel shaft, with the mandrels forming at least one mandrel group, whose mandrels are arranged in a plane perpendicular to the central axis of the mandrel wheel shaft, at least one first processing station which is arranged on the mandrel wheel and which comprises a drive, and a mandrel wheel drive to drive the mandrel wheel shaft.

Description of Related Art

Such devices are often used as part of a filling machine and also referred to as a "mandrel wheel group".

Packages can be produced in different manners and from the most varied materials. A widely used option for producing them is to produce a blank from the packaging material from which, by folding and further steps, firstly a package sleeve and lastly packaging emerges. This production method has the advantage, amongst other things, that the blanks are very flat and can therefore be stacked in a space-saving manner. In this way, the blanks or package sleeves can be produced at a different location to where the folding and filling of the package sleeves takes place. Composite materials are often used as the material, for example a composite made of a plurality of thin layers of paper, cardboard, plastic or metal, in particular aluminium. Such packaging is widely used in particular in the foodstuff industry.

Numerous devices and methods are known in the field of packaging technology by means of which flat folded package sleeves can be unfolded, sealed on one side, filled with contents and then completely sealed.

Sealing the package sleeves represents a particular challenge because a reliable seal of the package sleeves must be achieved through sealing which must also withstand subsequent transport and other loads. The sealing often takes place in a number of steps: firstly, the package sleeve is heated ("activated") in the region to be sealed. The opposing sides of the package sleeve are then pressed together ("compressed") in the regions to be sealed. The cohesion between the regions pressed together is for example achieved by an inner plastic layer being provided which is viscous when heated and therefore forms an adhesive when subsequently compressed. This operation is also referred to as "sealing".

To process, in particular to seal the underside of the package sleeves, so-called "mandrel wheels" are often used onto whose radially protruding mandrels the still unfilled package sleeve are pushed. The cross-section of the mandrels roughly corresponds to the cross-section of the packages to be produced such that the package sleeves already adopt the desired cross-sectional shape when pushed onto the mandrels.

While the package sleeve is on the mandrel, the processing of the package sleeve takes place in a clocked manner in the region of the protruding end of the mandrel. This has, on the one hand, the advantage that the package sleeves can be processed by rotating the mandrel wheel successively by different tools at different processing stations. For example, heating can take place in a first mandrel wheel position and then compression can take place in a second mandrel wheel position. A further advantage of processing the package sleeves on a mandrel wheel is that the shape of the protruding ends of the mandrels can be adapted to the shape of the underside of the packaging to be produced such that the ends of the mandrels can serve as counter bearings during compression.

One challenge when using mandrel wheels is in the drive of the mandrel wheel and the drive of the processing stations arranged on the mandrel wheel. One difficulty is that the processing of the package sleeves at the different processing stations must be matched precisely in time to the clocked movement of the mandrel wheel.

In order to achieve the required synchronicity, it was already proposed to use the same drive for the drive of the mandrel wheel and for the processing stations arranged thereon. The drive performance is in this case for example distributed over a timing belt into different belt discs and from there passed on to the respective processing station.

This principle is comparable with the function of a timing belt or a timing chain for a combustion engine with a plurality of cam shafts since the rotational position of the cam shafts, and therefore the position of the inlet and outlet valves, must be matched exactly to the position of the crank shaft and therefore the position of the piston. In order to precisely maintain the control times, the angle position of cam and crank shaft may not change. This is achieved by the crank shaft and all cam shafts being connected to one another in a positive-locking manner via a timing belt.

In addition to the synchronicity, a common drive is also used for reasons of compactness and for cost reasons. There is also an example of this from the field of combustion engines where a plurality of consumers are driven via the same V-belt by the crank shaft and therefore have the same drive. The consumers can for example be a generator ("alternator"), a water pump, a hydraulic pump or the like.

There are thus numerous reasons why the processing stations and the mandrel wheel share the same drive in the case of many mandrel wheels used in practice. Such a drive design known from the prior art is shown in FIG. 1 in schematic representation.

However, such a drive design also has disadvantages in addition to the mentioned advantages. A first disadvantage is that the mechanical connection of all processing stations with the same drive is constructively complex and requires a number of transmission elements (timing belts, belt discs, drive shafts, cam discs, etc.). A further disadvantage is the difficult maintenance since as soon as a defect occurs at a processing station and this processing station has to be uncoupled from the drive (e.g. by removing the timing belt), all processing stations coupled together must be precisely matched to one another in their rotational position in the case of recoupling (e.g. by mounting the timing belt). In short, an intervention in the drive of a processing station results in the entire drive system having to be reset. In addition, a new cam disc for the drive of the individual components has to be computed, manufactured, mounted and adjusted in the case of every small change to the packaging size or packaging geometry.

The object underlying the invention is to design and further develop the device described in the introduction such that the mechanical complexity of the device is reduced and the device can be easily maintained.

SUMMARY OF THE INVENTION

This object is achieved in the case of a device according in that a mandrel wheel drive is mechanically uncoupled from a drive of at least one processing station.

It concerns a device for producing packaging, in particular for processing package sleeves. In particular, it can in this case concern packaging or package sleeves for foodstuff, with the packaging or package sleeves preferably being produced from a composite material made of a plurality of thin layers of paper, cardboard, plastic or metal, in particular aluminium. The device firstly comprises a mandrel wheel comprising a mandrel wheel shaft with a central axis. The mandrel wheel shaft is preferably cylindrically shaped and the central axis runs in the longitudinal direction, i.e. in the axial direction, centrally through the mandrel wheel shaft. The mandrel wheel shaft can for example be produced from metal. The mandrel wheel also comprises a plurality of mandrels fastened to the mandrel wheel shaft. The fastening process serves the purpose that, in the case of rotation of the mandrel wheel shaft about its central axis, the mandrels also rotate about the central axis of the mandrel wheel shaft. Nevertheless, it may be a detachable fastening in order to be able to replace the mandrels. The cross-sectional surface of the mandrels can be designed rectangular, in particular square. The mandrels form at least one mandrel group, whose mandrels are arranged in a plane perpendicular to the central axis of the mandrel wheel shaft. The arrangement in one plane serves the purpose that the mandrels of the same mandrel group can be moved into the same positions successively by rotating the mandrel wheel shaft in order to enable processing of the package sleeves by different stationary tools. Furthermore, the device comprises at least one first processing station which is arranged on the mandrel wheel and comprises a drive and a mandrel wheel drive to drive the mandrel wheel shaft. The drive can for example be an electric motor. The processing station can for example be a push-on device, a heating unit, a folding unit (e.g. longitudinal folder, lateral folder), a press or a pull-off device.

According to the invention, it is provided that the mandrel wheel drive is mechanically uncoupled from the drive of the at least one processing station. Mechanical uncoupling is in particular understood as the two drives not being mechanically connected to one another. The aim of the mechanical uncoupling is for example being able to individually operate the two drives in regard to all drive parameters (speed, rotational direction, etc.). One effect of the mechanical uncoupling is that a defective drive on the mandrel wheel can be replaced without the drive of the processing station being affected by this. The processing station can be a push-on device, a heating unit, a folding unit (e.g. longitudinal folder, lateral folder), a press or a pull-off device. In practical tests however, it has been found that a mechanical uncoupling of the mandrel wheel drive from the press ("base press") and from the folding unit (in particular the longitudinal folder) entails particular advantages. This is in particular due to the fact that particularly high dynamic forces are required at these processing stations (press/longitudinal folders) or that particularly complex movements precisely matched in time are required at these processing stations (longitudinal folder). Both can be easily detached with separate drives matched to the respective requirements.

A further development of the device is characterised by a second processing station which is arranged on the mandrel wheel and comprises a drive. In this case, it can be provided that the mandrel wheel drive is mechanically uncoupled from the two drives of the at least two processing stations. The second processing station can be a push-on device, a heating unit, a folding unit (e.g. longitudinal folder, lateral folder), a press or a pull-off device, if these are not already provided as the first processing station. The terms "first" and "second" processing station serve merely to distinguish and give no indication as to the sequence of the processing. The idea is thus to uncouple the mandrel wheel drive not only from the drive of a processing station, but rather also uncouple the mandrel wheel drive from the drive of a second processing station, if at least two processing stations are provided. The drive of the first processing station and the drive of the second processing station are also preferably mechanically uncoupled from one another.

The device can be supplemented according to a further configuration with a third processing station which is arranged on the mandrel wheel and which comprises a drive. In this case, it can be provided that the mandrel wheel drive is mechanically uncoupled from the three drives of the at least three processing stations. The third processing station can be a push-on device, a heating unit, a folding unit (e.g. longitudinal folder, lateral folder), a press or a pull-off device, if these are not already provided as the first or as the second processing station. The terms "first", "second" and "third" processing station serve merely to distinguish and give no indication as to the sequence of the processing. The idea is thus to uncouple the mandrel wheel drive not only from the drive of the first two processing station, but rather also uncouple the mandrel wheel drive from the drive of a third processing station, if at least three processing stations are provided. The drive of the first processing station, the drive of the second processing station and the drive of the third processing station are also preferably mechanically uncoupled from one another.

According to a further design of the device, it is provided that the mandrel wheel drive is mechanically uncoupled from the drives of all processing stations. The idea underlying this design of uncoupling the mandrel wheel drive from the drive of all processing stations, irrespective of how many processing stations are provided. The drives of all processing stations are also preferably mechanically uncoupled from one another.

A further embodiment of the invention provides that one of the processing stations is a press, in particular a base press to compress the base surfaces of the package sleeves. The end regions of the package sleeves are compressed at the base press to form a base. This processing step requires high forces and determines whether the packaging is thick in the region of its base. Against this background, the mechanical uncoupling of the drive of the press from the mandrel wheel drive has the advantage that the drive of the press can be selected and set in a target manner in regards to the mentioned requirements. In addition, separate drives enable a better response to the situation where the press is pressed on the package base at a time when the mandrel wheel is stationary. This can only be implemented in a complex manner using mechanically coupled drives. Through mechanical uncoupling, additional mechanical components (e.g. a timing belt or a curve disc) can be dispensed with, whereby less wear, friction, clearance and elasticity can be achieved. Therefore, the positional accuracy of the base press increases relative to the mandrel (currently) assigned to it in each case. The positional accuracy is relevant for the leak-tightness of the base and therefore for the quality of the packaging.

According to a further design of the device, it is provided that one of the processing stations is a folding device, in particular a longitudinal folder or a lateral folder to fold the base surfaces of the package sleeves. The folding of the end regions of the package sleeves takes place at the folding device. In particular, it may concern a longitudinal folder (folding movement in the circumferential direction of the mandrel wheel) or a lateral folder (folding movement in the direction of the central axis of the mandrel wheel). When folding the package sleeve, particularly complex movements have to take place in a precisely matched manner. The mechanical uncoupling of the drive of the folding device from the mandrel wheel drive has the advantage that the drive of the folding device can be selected and set in a target manner in regards to the mentioned requirements. In addition, separate drives enable a better response to the situation where the folding takes place at a time when the mandrel wheel is stationary. This can only be implemented in a complex manner using mechanically coupled drives. Through mechanical uncoupling, additional mechanical components (e.g. a timing belt) can also be dispensed with here, whereby less wear, friction, clearance and elasticity can be achieved. Therefore, the positional accuracy of the folding device increases relative to the mandrel (currently) assigned to it in each case. The positional accuracy is relevant for the leak-tightness of the base and therefore for the quality of the packaging. Furthermore, when changing the packaging size or packaging geometry, the movement of the longitudinal folder can be easily adapted via the controller, in particular the motor controller; in contrast, changing the curve disc is not necessary.

In a further configuration of the device, it is provided that one of the processing stations is a push-on device to push the package sleeves on one of the mandrels. Alternatively or additionally, it can be provided that one of the processing stations is a pull-off device to the package sleeves off one of the mandrels. The pushing-on and pulling-off of the package sleeves can also only take place when the mandrel wheel is stationary. Such an asynchronous movement can be implemented only in a complex manner using mechanically coupled drives. A further advantage of a mechanically uncoupled drive is that, owing to the lack of some mechanical components, the reachability or accessibility of the push-on device/pull-off device is improved. This is in particular helpful during service or when checking the activation profile or also when removing defective or jammed packaging. The risk of injury, which for example exists owing to the proximity to hot components (e.g. base heating), can also be reduced through improved reachability or accessibility.

According to a further design of the device, it is provided that the mandrel wheel comprises at least two, in particular at least four mandrel groups. According to a further configuration of the device, it is provided that each mandrel group comprises at least four mandrels, in particular at least six mandrels. A higher number of mandrel groups allows a number of lines of package sleeves to be processed simultaneously. A higher number of mandrels per mandrel group allows a higher number of processing steps to be carried out on the package sleeves.

A further configuration of the device provides that a drive unit is used as the mandrel wheel drive which comprises an electric motor and a transmission. Alternatively to this, it can be provided that a direct drive is used as the mandrel wheel drive. Alternatively or additionally, it can be provided that a drive unit is used as the drive of at least one processing station which comprises an electric motor and a transmission. Alternatively to this, it can be provided that a direct drive is used as the drive of at least one processing station.

High requirements are placed on the drives used. In particular, the drives must be suitable for adopting a determined rotational position at a predetermined time and very precisely maintaining this rotational position even under load. The maintenance of determined angular positions is provided for example by a timing belt in the case of mechanically coupled drives. Tests have shown that in particular drives with a low rotational clearance and a high torsional rigidity are suitable.

The drive unit or the direct drive together with the mandrel wheel driven thereby or together with the processing station driven thereby preferably has a torsional rigidity of ≥450 Nm/arcmin, ≥500 Nm/arcmin, ≥550 Nm/arcmin, ≥600 Nm/arcmin or ≥650 Nm/arcmin. The torsional rigidity thus does not relate to the drive unit or the direct drive alone; it instead relates to the respective system of drive unit or direct drive and components driven thereby.

The drive unit or the direct drive together with the mandrel wheel driven thereby or together with the processing station driven thereby preferably has a rotational clearance ≤5 arcmin, ≤3 arcmin or ≤1 arcmin. A rotational clearance of 0 arcmin (clearance-free) is particular preferred. The torsional rigidity thus does not relate to the drive unit or the direct drive alone; it instead relates to the respective system of drive unit or direct drive and components driven thereby.

The drive unit or the direct drive together with the mandrel wheel driven thereby or together with the processing station driven thereby preferably has a tilting rigidity of ≥850 Nm/arcmin, ≥1000 Nm/arcmin, ≥1200 Nm/arcmin or ≥1300 Nm/arcmin. The tilting rigidity thus does not relate to the drive unit or the direct drive alone; it instead relates to the respective system of drive unit or direct drive and components driven thereby. A wobbling movement is avoided by a sufficiently high tilting rigidity between the motor and the components connected thereto.

Instead of a unit made of electric motor and (preferably clearance-free) transmission, a direct drive, i.e. an electric motor without separate transmission, can also be used, for example a hollow shaft direct drive. Alternatively to this, a torque motor without a transmission can also be used as the direct drive. Direct drives are characterised by the property of being able to be mounted, without interconnected transmission, on the shaft of the component to be driven. The omission of a transmission has the advantage of a compact structure with little or even no clearance.

In the case of the mechanically coupled structure known from the prior art, the position regulation of the electric motor is difficult to design since the moment of inertia of the system to be driven is not constant, but rather is time-variable. This is for example due to the superimposition of a plurality of complex dynamic processes with unequally geared mechanisms.

In the case of a mechanically uncoupled structure proposed here, the position regulation of the electric motor can, in contrast, take place by torque pre-control, i.e. by specifying the moments of inertia resulting from the calculation. It is specifically proposed that the device or its drive has a controller in which at least one time course of a moment of inertia is stored. Each drive can have its own controller; a common controller can, however, also be provided for a plurality of drives.

Thus far, so-called tracking errors were feared which, during the course of the production period, cause the synchronicity to worsen. In order to avoid this, it can be provided that the moved masses, preferably on their backwards movement from the working position, pass through a reference point. In this way, any deviations that occur can be balanced out. Such tracking errors can also be avoided by pre-control of the speed and/or moment.

BRIEF DESCRIPTION OF THE DRAWINGS

The invention is explained below on the basis of a drawing representing merely one preferred exemplary embodiment.

DESCRIPTION OF THE INVENTION

Figure 1:
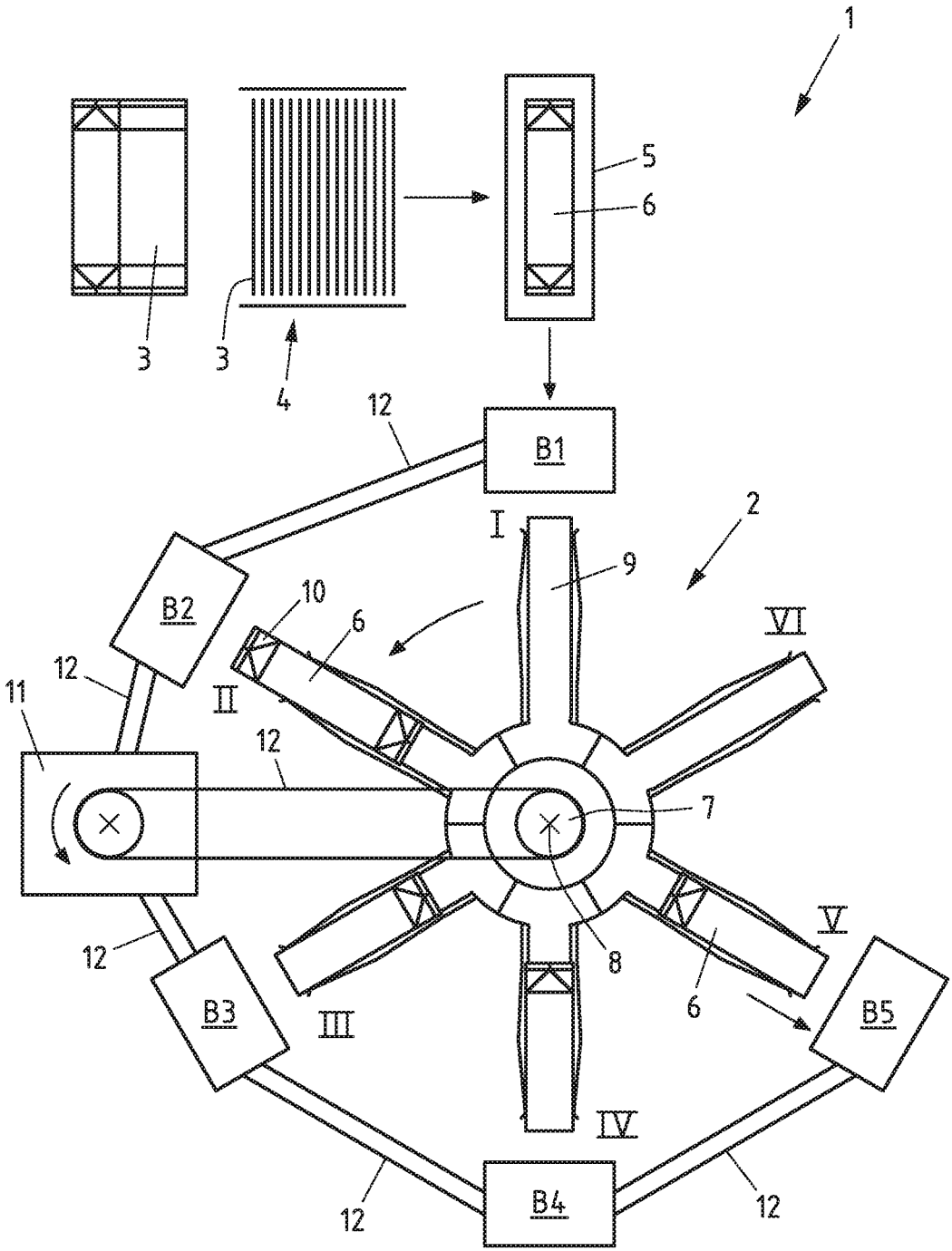
FIG. 1: a device known from the prior art for producing packaging comprising a mandrel wheel in schematic representation and FIG. 2 a device according to the invention for producing packaging comprising a mandrel wheel in schematic representation.

FIG. 1 shows a device 1 known from the prior art for producing packaging comprising a mandrel wheel 2 in schematic representation. Firstly, flat blanks 3 are introduced into a magazine 4 and then unfolded in a folding device 5 into package sleeves 6. The device 1 comprises a mandrel wheel 2 with a mandrel wheel shaft 7 with a central axis 8. Six mandrels 9 are fastened to the mandrel wheel shaft 7. The six mandrels 9 shown in FIG. 1 form a mandrel group, whose mandrels 9 are arranged in a plane perpendicular to the central axis 8 of the mandrel wheel shaft 7. The mandrel wheel 2 can be moved further in a clocked manner counter clockwise (represented by an arrow) and in doing so held in six different mandrel wheel positions I-VI. In each case one processing station B1-B5 is arranged in the mandrel wheel positions I-V before the end of the mandrels 9, at which stations the package sleeves 6 are supposed to be processed in their end regions 10, for example in their base regions.

The device 1 shown in FIG. 1 also has a mandrel wheel drive 11 to drive the mandrel wheel shaft 7. The mandrel wheel drive 11 is mechanically coupled to the mandrel wheel shaft 7, for example via a timing belt 12. The mandrel wheel drive 11 drives not only the mandrel wheel shaft 7, but it also drives the processing stations B1-B5. To this end, the mandrel wheel drive 11 is mechanically coupled to each of the processing stations B1-B5, for example via timing belts 12 (represented only schematically in FIG. 1) and/or other suitable coupling elements such as shafts, gearwheels and the like.

Figure 2:
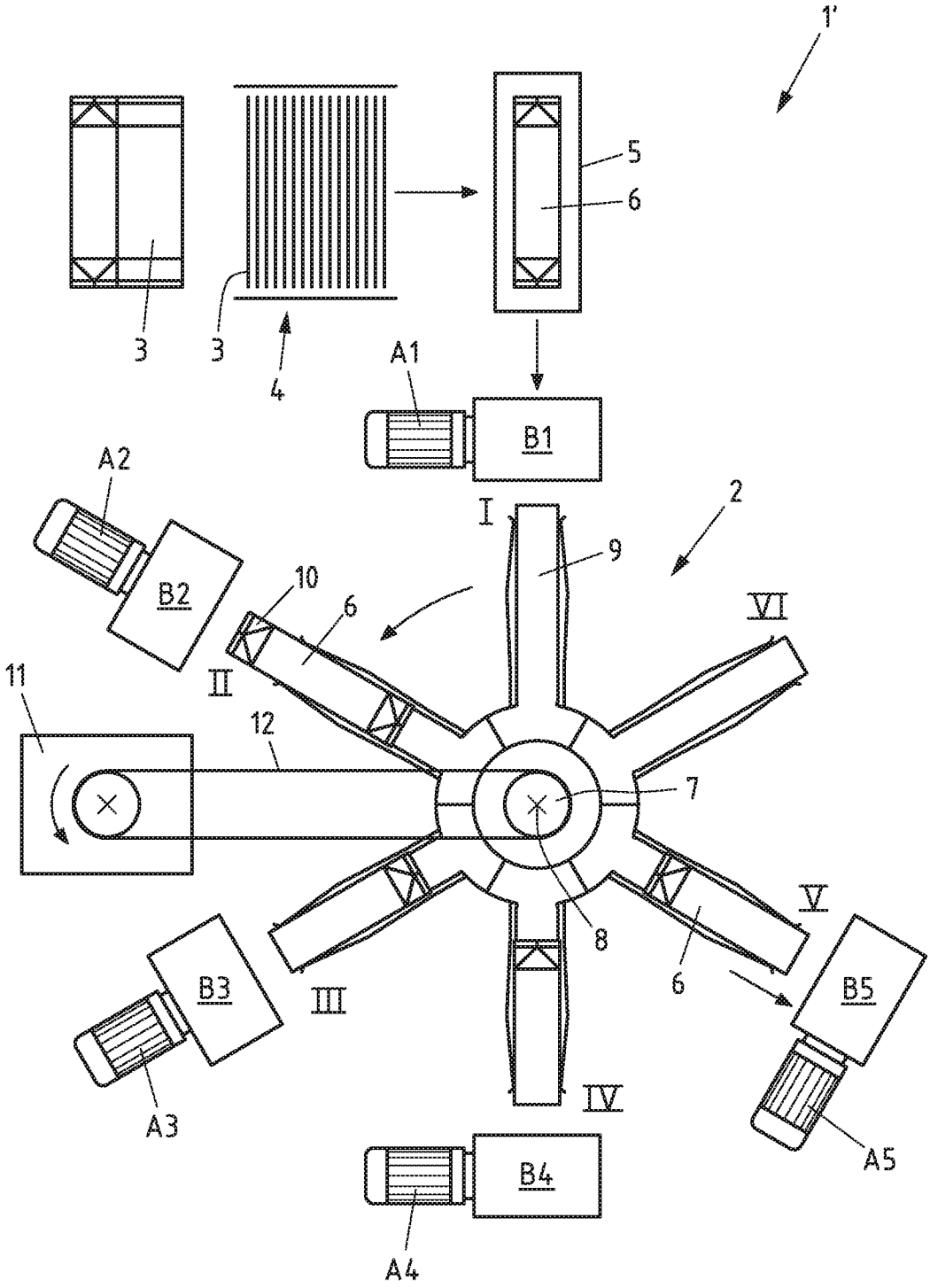

A device 1' according to the invention is shown in FIG. 2 for producing packaging comprising a mandrel wheel 2 in schematic representation. Such regions of the device 1', which were already described in relation to FIG. 1, are provided with corresponding reference numerals in FIG. 2. An essential difference with the device 1 known from the prior art (FIG. 1) is that the device 1' according to the invention has a different drive design. In particular, in the case of the device shown in FIG. 2, it is provided that each processing station B1-B1 has its own drive A1 to A5 and that the mandrel wheel drive 11 is mechanically uncoupled from the drives A1-A5 of all processing stations B1-B5.

On the basis of the device 1 shown in FIG. 2, the production of packaging (open on one side) is supposed to be represented by way of example. Firstly, the already unfolded package sleeves 6 are taken from the first processing station, which is a push-on device B1, and pushed onto the mandrel 9 which is located in the mandrel wheel position I. The push-on device B1 is to this end driven by its own drive A1 which is mechanically uncoupled from the mandrel wheel drive 11 (and the other drives A2, A3, A4, A5).

The mandrel wheel 2 is then rotated from the mandrel wheel position I into the mandrel wheel position II. The mandrel wheel shaft 7 of the mandrel wheel 2 is to this end driven by the mandrel wheel drive 11 which is mechanically uncoupled from the drives A1-A5 of all processing stations B1-B5.

In the second mandrel wheel position II, the package sleeves 6 are heated in their end regions 10 by the second processing station, which is a heating unit B2. The heating unit B2 is to this end moved by its own drive A2 which is mechanically uncoupled from the mandrel wheel drive 11 (and the other drives A1, A3, A4, A5).

The mandrel wheel 2 is subsequently rotated from the mandrel wheel position II into the mandrel wheel position III. The mandrel wheel shaft 7 of the mandrel wheel 2 is to this end in turn driven by the mandrel wheel drive 11 which is mechanically uncoupled from the drives A1-A5 of all processing stations B1-B5.

In the third mandrel wheel position III, the folding of the end regions 10 of the package sleeves 6 takes place through the third processing station which is a folding unit B3. In particular, it can be a longitudinal folder (folding movement in the circumferential direction of the mandrel wheel 2) or a lateral folder (folding movement in the direction of the central axis 8 of the mandrel wheel 2). The folding unit B3 is to this end moved by its own drive A3 which is mechanically uncoupled from the mandrel wheel drive 11 (and the other drives A1, A2, A4, A5).

The mandrel wheel 2 is then rotated from the mandrel wheel position III into the mandrel wheel position IV. The mandrel wheel shaft 7 of the mandrel wheel 2 is to this end in turn driven by the mandrel wheel drive 11 which is mechanically uncoupled from the drives A1-A5 of all processing stations B1-B5.

In the fourth mandrel wheel position IV, the compression of the end regions 10 of the package sleeves 6 takes place through the fourth processing station which is a press B4 which is also designated as "base press". The press B4 is to this end moved by its own drive A4 which is mechanically uncoupled from the mandrel wheel drive 11 (and the other drives A1, A2, A3, A5).

The mandrel wheel 2 is then rotated from the mandrel wheel position IV into the mandrel wheel position V. The mandrel wheel shaft 7 of the mandrel wheel 2 is to this end in turn driven by the mandrel wheel drive 11 which is mechanically uncoupled from the drives A1-A5 of all processing stations B1-B5.

In the fifth mandrel wheel position V, the package sleeves 6 are pulled off the mandrel 9 by the fifth processing station which is a pull-off device B5 in order to be able to be supplied to further processing steps no longer taking place on the device 1'. The pull-off device B5 is to this end moved by its own drive A5 which is mechanically uncoupled from the mandrel wheel drive 11 (and the other drives A1, A2, A3, A4).

After the package sleeves 6 have passed through the processing stations B1 to B6, the package sleeves 6 are sealed on one side (e.g. in the region of the base) and can be filled in subsequent work steps and sealed from the other side (e.g. in the region of the gable).

LIST OF REFERENCE NUMERALS

1, 1': device
2: mandrel wheel
3: blank
4: magazine
5: unfolding device
6: package sleeve
7: mandrel wheel shaft
8: central axis
9: mandrel
10: end region (of the package sleeve 6)
11: mandrel wheel drive
12: timing belt
A1-A5: drive (of a processing station B1-B1)
B1-B5: processing station
B1: push-on device
B2: heating unit
B3: folding unit
B4: press
B5: pull-off device
I-VI: mandrel wheel position

The invention claimed is:

1. A device for producing packaging comprising:

a mandrel wheel with a mandrel wheel shaft with a central axis, a plurality of mandrels fastened to the mandrel wheel shaft, the plurality of mandrels forming at least one mandrel group, whose mandrels are arranged in a plane perpendicular to the central axis of the mandrel wheel shaft, a first processing station which is arranged on the mandrel wheel and comprising a drive, a second processing station which is arranged on the mandrel wheel and comprising a drive independent from the drive of the first processing station, wherein one of the processing stations is a press and one of the processing stations is a folding device, and a mandrel wheel drive to drive the mandrel wheel shaft, wherein the mandrel wheel drive is mechanically uncoupled and independent from the two independent drives of the first and second processing stations, wherein:

i) a drive unit is used as the drive of at least one of the first and second processing stations, the drive unit comprising an electric motor, a transmission, and a controller or ii) a direct drive is used as the drive of at least one of the first and second processing stations, the direct drive comprising an electric motor having no separate transmission and a controller, wherein in the controller, at least one time course of a moment of inertia is stored, and wherein a position regulation of the electric motor takes place by torque pre-control of the time course of the moment of inertia stored in the controller.

2. The device according to claim 1, wherein a third processing station is arranged on the mandrel wheel and comprises a drive.

3. The device according claim 2, wherein the mandrel wheel drive is mechanically uncoupled and independent from the three independent drives of the first, second, and third processing stations.

4. The device according to claim 1, wherein the mandrel wheel drive is mechanically uncoupled from the drives of all processing stations.

5. The device according to claim 1, further comprising a third processing station configured to be a push-on device with respect to one of the mandrels.

6. The device according to claim 1, further comprising a third processing station configured to be a pull-off device with respect to one of the mandrels.

7. The device according to claim 1, wherein the mandrel wheel comprises at least two mandrel groups.

8. The device according to claim 7, wherein the mandrel wheel comprises at least four mandrels.

9. The device according to claim 1, wherein each mandrel group comprises at least four mandrels.

10. The device according to claim 9, wherein each mandrel group comprises at least six mandrels.

11. The device according to claim 1, wherein a drive unit is used as the mandrel wheel drive which comprises an electric motor and a transmission.

12. The device according to claim 1, wherein a direct drive is used as the mandrel wheel drive.

13. The device according to claim 1, wherein the device is for processing packaging sleeves.

* * * * *